United States Patent [19]

Huang

[11] Patent Number: 4,824,098

[45] Date of Patent: Apr. 25, 1989

[54] THREE-DIMENSIONAL LABYRINTH

[76] Inventor: Hong Y. Huang, 3Fl., No. 26, Lane/68, Ta-Feng Road, Hsin-Tien City, Taipei Hsien, Taiwan

[21] Appl. No.: 237,437

[22] Filed: Aug. 29, 1988

[51] Int. Cl.[4] ..... A63F 7/04

[52] U.S. Cl. ..... 272/19; 273/113; 273/153 R

[58] Field of Search ..... 272/19; 273/113, 115, 273/153 R, 153 J

[56] References Cited

U.S. PATENT DOCUMENTS

| | | | |
|---|---|---|---|
| 1,294,013 | 2/1919 | Wittrup | 273/153 R X |
| 2,261,804 | 11/1941 | Hall | 273/153 R X |
| 4,465,280 | 8/1984 | Dimitriu | 273/153 R |
| 4,743,023 | 5/1988 | Collier | 273/113 |

FOREIGN PATENT DOCUMENTS

| | | | |
|---|---|---|---|
| 3220532 | 12/1983 | Fed. Rep. of Germany | 273/113 |
| 2113106 | 8/1983 | United Kingdom | 273/153 R |
| 2175217 | 11/1986 | United Kingdom | 273/153 R |

*Primary Examiner*—David A. Scherbel
*Assistant Examiner*—Richard E. Chilcot, Jr.

[57] ABSTRACT

A three-dimensional labyrinth comprising a transparent or translucent case within which a plurality of holed, cubic compartments are constructed, and a ball which is placed inside the case in advance. Each cubic compartment has a hole formed through each surface thereof and the ball which is to be moved out of the case can be moved in either way. A plurality of blockades are provided to block some of the holes and changing the route pattern of the labyrinth.

2 Claims, 4 Drawing Sheets

THREE-DIMENSIONAL LABYRINTH

BACKGROUND OF THE PRESENT INVENTION

The present invention relates to a mental game and, in particular, to a three-dimensional labyrinth which is a transparent or translucent case with a plurality of compartments formed therein and a plurality of passages formed randomly through the walls of the compartments so that an attendant has to observe and think in order to find a route to move a ball, which is placed in the case in advance, out of the case.

The labyrinth has been created and known for such a long time that people do not even know exactly when the labyrinth was created. The labyrinth was used to protect and hide something or to stop and block someone. But nowadays, it has become a puzzle to be solved by an attendant in the shortest time.

Conventionally, the labyrinth is a two-dimensional game, that is it allows the attendant to move in a plane, back and forth, to the right and left, but not upwards or downwards. A labyrinth usually provides many routes branched from each other for the attendant's choice, but only one leads to the destination, the other to dead ends.

Recently, a three-dimensional labyrinth has been created. Such a labyrinth is a transparent or translucent case of which the interior is compartmented. The compartments are randomly provided with passages which may communicate with either the right compartment, the left compartment, the front compartment, the back compartment, the upper compartment or the lower compartment. The puzzle is to move a ball placed inside the case in advance through the passages and finally out of the case. Since the passage are randomly provided through the compartments, the septa which construct the compartments are perforated randomly and differently.

SUMMARY OF THE INVENTION

Accordingly, it is the primary object of the present invention to provide a three-dimensional labyrinth of which the passages are equally-spaced on the speta so that the septa are identical in shape and size. This, certainly, reduces manufacturing cost.

It is a related object of the present invention to provide a three-dimensional labyrinth of which the passages can be blocked arbitrarily to change the route pattern.

Other advantages and objects can be observed by those having ordinary skill in the related art when the following description is read in conjunction with the attached drawings, in which:

DETAILED DESCRIPTION OF THE PREFERRED EMBODIMENT

Figure 1:
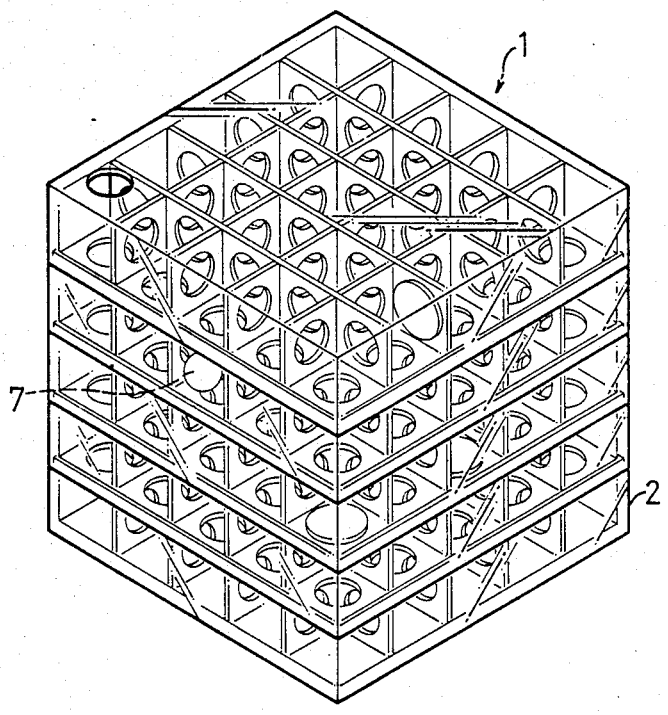
FIG. 1 is a perspective view of a three-dimensional labyrinth in accordance with the present invention.

Referring to FIG. 1, a three-dimensional labyrinth 1 in accordance with the present invention is basically a compartmented, transparent or translucent case.

Figure 2:
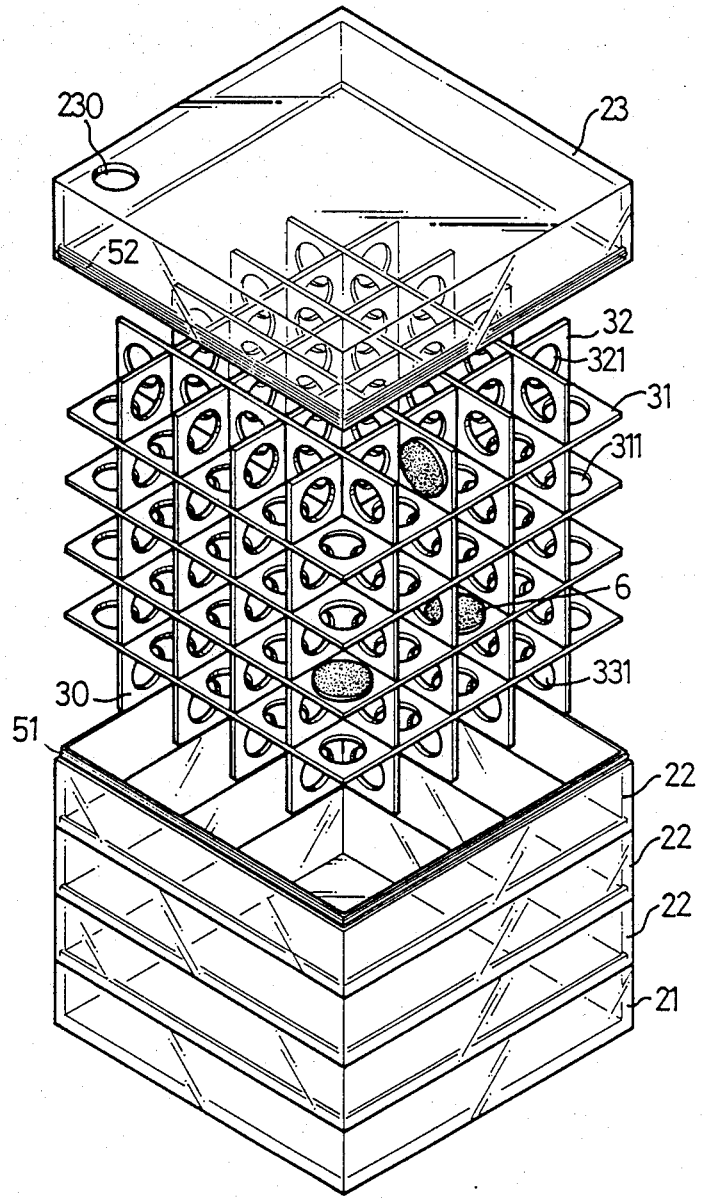
FIG. 2 is a fragmentary view, in which the cover of the case and the compartments are separated from the case of the three-dimensional labyrinth shown in FIG. 1.
Figure 3:
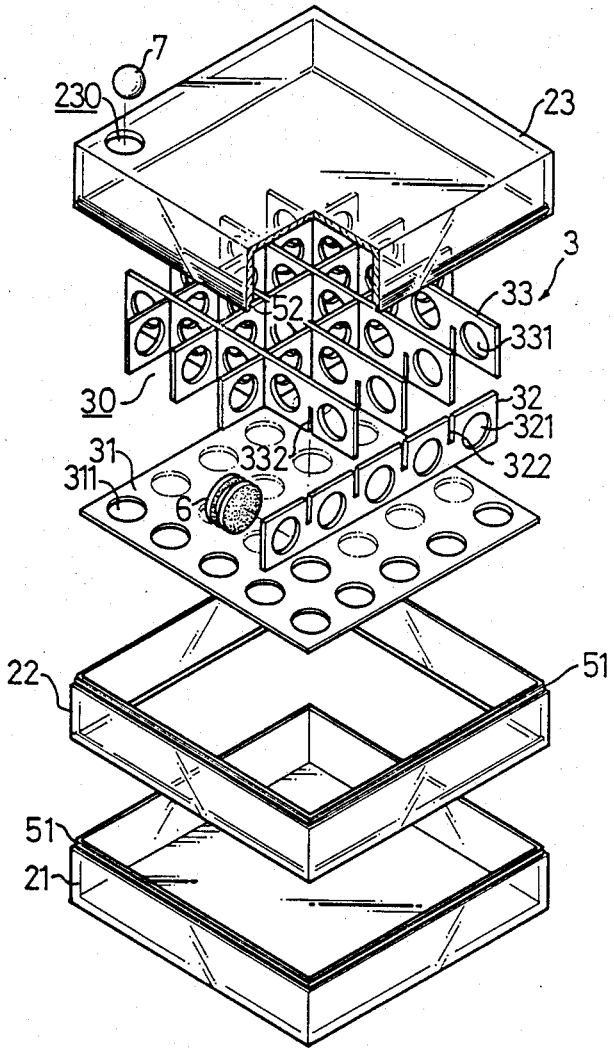
FIG. 3 is a view showing the parts which construct the compartments and the case.

Referring to FIG. 2, the compartmenting means which is disposed inside the case 2 is generally designated by the reference numeral 3. The compartmenting means 3 is constituted by a plurality of levels of which any two adjacent levels are separated by a transparent or transluent level plate 31. Formed through each level plate 31 are a plurality of identical holes 311 which are equally spaced and evenly distributed over the whole plate. The compartments of each level is constructed by a plurality of latitudinal septa 32 and longitudinal septa 33 intersecting and interlocking each other. Both latitudinal septa 32 and longitudinal septa 33 are made of transparent or translucent material. Each latitudinal septum 32, being a long strip, has a plurality of equally-spaced, identical holes 321 and a plurality of also equally-spaced, elongated notches 322 alternately formed therealong. The notches 322 are perpendicularly formed on one edge of the latitudinal septum 32 with the depth thereof substantially equal to or slightly greater than half of the width of the latitudinal septum 32. The longitudinal septum 33 is also a long strip with a plurality of equally-spaced, identical holes 331 and a plurality of also equally-spaced, elongated notches 332 alternately formed therealong. The notches 332 are perpendicularly formed on one edge of the longitudinal septum 33 with the depth thereof substantially equal to or slightly greater than half of the width of the longitudinal spetum 33. The widthes of both the latitudinal speta 32 and longitudinal septa 33 are substantially the same. The longitudinal speta 33 intersect and interlock the latitudinal septa 32 with the notches 332 thereof engaging with the notches 322 of the latitudinal septa 32 so as to construct the compartments 30 of a level with each compartment thereof corresponding to a hole 311 formed in the level plate 31.

The case 2 is constituted by a bottom casing 21 which is like a box without the cover, a top casing 23 which is like a box without the bottom, and a plurality of intermediate casings 22 which are like boxes without both the cover and the bottom. The internal heights of both the top casing 23 and the bottom casing 21 are substantially the same as each other and the same as the width of either the latitudinal septa 32 or the longitudinal septa 33. The internal height of each intermediate casing 22 is substantially the same as the height of each level including both the septa 32 and 33 and the level plate 31. This ensures that when the compartment means 3 is placed inside the case 2, it can precisely match the interior of the case 2.

Figure 4:
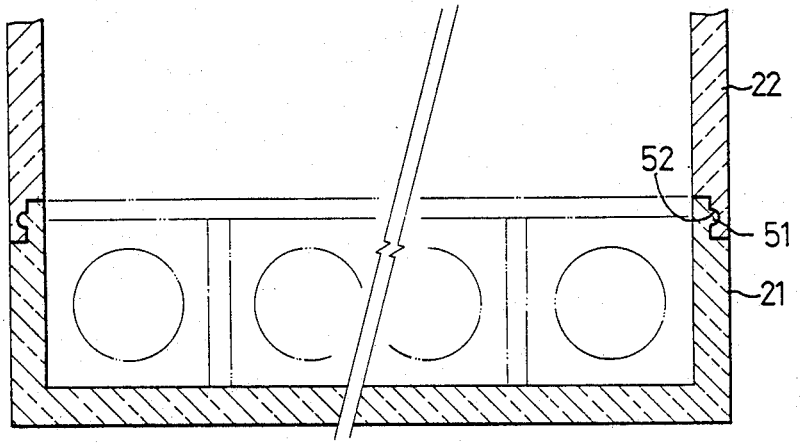
FIG. 4 is a cross-sectional view showing the engagement of the parts which constitute the case.

The intermediate casings 22 are stacked on and secured to the bottom casing 21 with an engaging means which is general designated by the reference numeral 5. The top casing 23 is secured to the top of the stack of the intermediate casings 22 with the same engaging means 5. Referring to FIG. 4, the engaging means comprises an outward, peripheral projection 51 formed on the uppermost portion of the bottom casing 21 and each of the intermediate casing 22, and an inward, peripheral slot 52 formed on the lowermost portion of the top casing 23 and each of the intermediate casings 22. With th projection 51 engaging the slot 52, a casing is secured to another casing. The thickness of the portion of the side walls where the projection 51 and the slot 52 are formed may be reduced to half of the original thickness so that when a casing is secured to another, the thickness of the overlapped portion of the side walls can be the same as the other portion.

The three-dimensional labyrinth 1 further comprises a plurality of dumbell-like blockades 6 and a ball 7. The diameter of the ball 7 is substantially the same as or smaller than that of the holes formed in the level plate 31 or the septa 32 or 33 so that the ball 7 can pass through each hole 311, 321 or 331. The dumbell-like blockade 6 is made of soft and resilient material so that it can be forced to engage with any hole formed in either the level plate 31 or the septa 32 or 33, blocking the hole.

To play the three-dimensional labyrinth 1, a plurality of passages 311, 321 or 331 are randomly blocked and the ball 7 is arbitrarily placed inside the case 1. The attendant must figure out a route to move the ball 7 out of the case 1 via a hole 230 formed in a corner of the top casing 23.

It is to be understood that the embodiment of the present invention as shown and described is to be regarded as illustrative only and that the invention is susceptible to variations, modifications and changes within the scope of the appended claims.

I claim:

1. A three-dimensional labyrinth comprising a transparent or translucent case, a plurality of levels of compartments disposed inside said case, a ball and plurality of dumbell-like blockades;

said case being constituted by a bottom casing which is like a box without the cover, a top casing which is like a box without a bottom and which a hole formed thereon, and a plurality of intermediate casings which are like boxes without both the cover and the bottom and are stacked between said bottom casing and top casing, each casing being secured to another with an engaging means;

each level of said compartments being separated from each other with a level plate which has a plurality of equally-spaced and evenly-distributed holes formed therethrough, and being constructed by a plurality of latitudinal septa and a plurality of longitudinal septa perpendicularly intersecting and interlocking each other, each of said septa, being a strip, having a plurality of holes and elongated notches alternately and equally spaced therealong so that the elongated notches of said longitudinal septa is engageable with the notches of said latitudinal septa to construct compartments of a level;

said dumbell-like blockades which are made of soft and resilient material, being able to be forced to engage with a plurality of holes formed either on said level plate or on said septa and blocking said holes so as to define a route pattern to allow said ball which is placed inside said case in advance to be moved out of said case via said hole formed on said cover casing.

2. A three-dimensional labyrinth as set forth in claim 1 wherein said engaging means comprises a peripheral projection formed on the uppermost portion of said bottom casing and each of said intermediate casings, and a peripheral notch, corresponding to said projection, formed on the lowermost portion of said top casing and each of said intermediate casings to be engaged by said projection when a casing is stacked on another;

the thickness of the portion of the side walls where said projection or said notch is formed being substantially half of the thickness of the other portion of the side walls so that when said projection engages said notch, the total thickness thereof is the same as the thickness of the other portion of the side walls.

* * * * *